US007841802B2

(12) United States Patent
Fockersperger, Jr.

(10) Patent No.: US 7,841,802 B2
(45) Date of Patent: Nov. 30, 2010

(54) STRAND-LIKE MATERIAL LAYING DEVICE FOR CUTTING THE GROUND AND INSERTING STRAND-LIKE MATERIAL INTO THE GROUND

(75) Inventor: Walter Fockersperger, Jr., Eberspointestr 22, 84189, Pauluszell/Ndb (DE)

(73) Assignee: Walter Fockersperger, Jr., Pauluszell/Ndb. (DE)

( * ) Notice: Subject to any disclaimer, the term of this patent is extended or adjusted under 35 U.S.C. 154(b) by 279 days.

(21) Appl. No.: 11/966,869

(22) Filed: Dec. 28, 2007

(65) Prior Publication Data

US 2009/0010716 A1 Jan. 8, 2009

Related U.S. Application Data

(60) Provisional application No. 60/877,992, filed on Dec. 29, 2006.

(51) Int. Cl.
*E02F 5/10* (2006.01)

(52) U.S. Cl. ..... 405/180; 405/174; 405/181; 405/184; 405/154.1; 37/347; 37/367; 37/370

(58) Field of Classification Search ..... 405/174, 405/180, 181, 183, 184, 154.1; 37/347, 366, 37/367, 370, 378, 142.5
See application file for complete search history.

(56) References Cited

U.S. PATENT DOCUMENTS

| | | | | |
|---|---|---|---|---|
| 2,118,553 | A | | 5/1938 | Garlinger |
| 2,631,389 | A | | 3/1953 | Stovall et al. |
| 3,066,491 | A | | 12/1962 | Ryan |
| 3,099,098 | A | | 7/1963 | Davis |
| 3,429,134 | A | | 2/1969 | Coffey |
| 3,486,344 | A | | 12/1969 | Ylinen |
| 3,684,030 | A | * | 8/1972 | Lucero ..... 172/700 |
| 3,747,357 | A | | 7/1973 | Erickson et al. |
| 3,788,085 | A | | 1/1974 | Holberg |
| 3,899,037 | A | | 8/1975 | Yuker |
| 4,053,998 | A | * | 10/1977 | Ezoe ..... 37/367 |
| 4,079,593 | A | * | 3/1978 | Flippin ..... 405/182 |
| 4,365,927 | A | | 12/1982 | Schenck |
| 4,389,799 | A | | 6/1983 | Norton et al. |
| 4,448,567 | A | | 5/1984 | Tsuda |
| 5,238,225 | A | | 8/1993 | Hunt |

FOREIGN PATENT DOCUMENTS

| | | |
|---|---|---|
| DE | 491887 | 2/1930 |
| DE | 1102231 | 3/1961 |

(Continued)

*Primary Examiner*—Jennifer H Gay
*Assistant Examiner*—Sean D Andrish
(74) *Attorney, Agent, or Firm*—Morrison & Foerster LLP

(57) ABSTRACT

A strand-like material laying device for an appliance for laying any kind of strand-like material into the ground is disclosed. The strand-like material laying device is designed to lay a more rigid strand-like material such as steel pipes into the ground, and assures that the strand-like material to be laid can smoothly be fed into a trench formed in the ground without risking that a bending radius thereof falls below a minimum allowable bending radius which depends on the type of the strand-like material to be laid. The strand-like material laying device can also be immersed into the ground to form a subterranean trench while being moved in a longitudinal direction.

23 Claims, 8 Drawing Sheets

FOREIGN PATENT DOCUMENTS

| | | | |
|---|---|---|---|
| DE | 1189602 | | 3/1965 |
| DE | 1906244 | | 8/1970 |
| DE | 2631667 | | 2/1977 |
| DE | 2806379 | | 8/1978 |
| DE | 2840956 | | 4/1980 |
| DE | 3245623 | | 7/1983 |
| DE | 3245624 | | 7/1983 |
| DE | 3245626 | | 7/1983 |
| DE | 3245625 | | 9/1983 |
| DE | 3317053 | | 11/1984 |
| DE | 3326531 | | 1/1985 |
| DE | 3428040 | | 9/1985 |
| DE | 3425369 | | 1/1986 |
| DE | 8809959 | U1 | 11/1988 |
| DE | 9104456 | U1 | 7/1991 |
| DE | 4017379 | | 10/1991 |
| DE | 4210858 | | 10/1993 |
| DE | 19623922 | | 2/1998 |
| DE | 19757729 | | 6/1999 |
| DE | 19928682 | | 1/2001 |
| DE | 19928683 | | 1/2001 |
| DE | 10115456 | | 10/2002 |
| DE | 10142376 | | 4/2003 |
| DE | 50102971-D | | 9/2004 |
| EP | 0585188 | | 3/1994 |
| EP | 1063458 | | 12/2000 |
| EP | 1167636 | | 1/2002 |
| EP | 1167681 | | 1/2002 |
| EP | 1277889 | | 1/2003 |
| GB | 1267501 | | 3/1972 |
| NL | 279462 | | 6/1962 |
| NL | 9201058 | | 1/1994 |
| WO | WO-86/00356 | | 1/1986 |
| WO | WO-99/54556 | | 10/1999 |

* cited by examiner

STRAND-LIKE MATERIAL LAYING DEVICE FOR CUTTING THE GROUND AND INSERTING STRAND-LIKE MATERIAL INTO THE GROUND

FIELD OF THE INVENTION

The present invention relates generally to a strand-like material laying device for appliances for laying strand-like material of endless length, such as steel pipes, conduits, cables, etc., into a trench formed in the ground.

BACKGROUND OF THE INVENTION

Various appliances have been suggested which include a device for forming a trench having substantially vertical side walls in the ground, and for laying strand-like material of endless length, such as conduits, pipes and cables, into the trench. It should be noted that "endless length" designates a material which is very long in comparison with the length of the device laying the material, and does not require that the material be of infinite length. Such appliances are described e.g. in WO 86/00536 A1, U.S. Pat. No. 3,747,357, U.S. Pat. No. 3,486,344, U.S. Pat. No. 3,486,344, U.S. Pat. No. 3,429,134, DE 1 189 602 A1, DE 32 45 625 A1, DE 25 29 285 A1, DE 28 06 379 A1 or DE 491 887 B1 and typically comprise a support vehicle, a blade connected to and supported by the support vehicle for lifting and lowering, and a feeding means mounted in connection with the blade for pivotal movement about a horizontal axis and feeding the strand-like material from a storage reel rotatably mounted on the support vehicle, through an internal guide channel into a subterranean trench formed by the blade immersed into the ground when moving the support vehicle. With such appliances, in a single step a vertical trench can be formed in the ground and a strand-like material can be fed into the trench and laid onto the base of the trench while the support vehicle is moved forwardly.

The above mentioned appliances are designed for laying a strand-like material of relative high flexibility, such as cables, wound on a storage reel. However, such appliances are not appropriate in cases where strand-like material of relatively low flexibility and of "endless" length, such as more rigid steel pipes like gas pipes, oil pipes, etc., are to be laid. Normally, strand-like material of the latter mentioned more rigid or less flexible type is not fed from a storage reel but rests on the ground surface prior to being laid into the ground and is picked up, fed along a curved path into a trench formed in the ground by the appliance. In order to reduce a risk of being damaged or broken due to failing below a minimum allowable bending radius of the strand-like material of the more rigid or less flexible type to be laid, the curved path must be set so as to assure a sufficiently large radius of curvature, so that the length of the known appliances becomes very large if more rigid strand-like material is to be laid into the trench.

SUMMARY OF THE INVENTION

The present invention provides a strand-like material laying device for an appliance for laying any kind of strand-like material into the ground. A strand-like material laying device according to the present invention is designed to lay a more rigid strand-like material such as steel pipes into the ground. A strand-like material laying device according to the present invention assures that a strand-like material to be laid can smoothly be fed into a trench formed in the ground without risking that a bending radius thereof falls below a minimum allowable bending radius which depends on the type of the strand-like material to be laid.

The present invention provides a strand-like material laying device for immersing into the ground to form a subterranean trench while being moved in a longitudinal direction. To this end the strand-like material laying device comprises a first unit for cutting the ground to form said trench and guiding said strand-like material into said trench, said first unit having a plurality of first elements which are connected in series like a flexible chain. Each of the plurality of first elements has at its front end a cutting edge wherein the cutting edges of two successive ones of the plurality of first elements are offset with respect to each other in depth direction of the strand-like material laying device so that a cutting depth of the strand-like material laying device increases in a direction opposed to the direction of movement thereof. Two successive ones of the plurality of first elements are coupled with each other for pivotal movement about an axis being substantially parallel to the depth direction of the strand-like material laying device, which corresponds to the vertical direction when using the strand-like material device.

Due to its flexibility in lateral direction by the chain-like series connection of the plurality of first elements for pivotal movement about a substantially vertical axis the strand-like material laying device allows for a compensation of changing lateral forces acting on the cutting and inserting elements when cutting and ploughing the ground. Lateral forces acting on the cutting and inserting elements when cutting and ploughing the ground may change between left and right sides as well as between front and rear sides of the strand-like material laying device i.e. in lateral and longitudinal direction of the strand-like material laying device, due to variations of ground conditions as regards the ground constitution (gravel, sand, clay, etc.), the existence of obstacles (stones, root systems, etc.) included in the ground, as well as atmospheric conditions within the ground (frost and frost-free ground sections).

Offsetting the cutting edges of respective two successive elements of the plurality of first elements in depth direction so that a working depth of the two successive elements increases in a direction opposed to the direction of movement of the strand-like material laying device enables the division of the overall longitudinal force acting on the strand-like material laying device when being moved forward, into a plurality of longitudinal force components each acting on a respective one of the cutting and inserting elements. Thus a risk for the strand-like material laying device when being moved in the longitudinal direction to experience a torque causing the strand-like material laying device to tilt about a front end thereof is reduced.

A pivotal movement of said two successive ones of the plurality of first elements may be limited to a predetermined maximum angle of pivotal movement. This maximum angle of pivotal movement of said two successive ones of the plurality of first elements may be adjustably set on the basis of the type of strand-like material to be laid into the trench formed in the ground. In most cases it may be sufficient if said angle of pivotal movement is limited to be within a range of 1 and 3 degrees.

Furthermore, different cutting edges may be exchangeably mounted to each element of the plurality of first elements, so as to be able to adapt these first elements to any prevailing ground conditions.

In order to generate downwardly directed reaction forces, the cutting edges may be inclined slightly downward from a horizontal level so as to terminate at a bottom end of the respective element and form a blade nose projecting in the direction of movement of the strand-like material laying device.

At least one of the plurality of first elements may have as means for controlling the working depth thereof, a fin-like shoe coupled to said nose for pivotal movement about an axis which is substantially perpendicular with respect to the depth direction and direction of movement of the strand-like material laying device. Preferably, a pivotal movement of said fin-like shoe is limited to a predetermined angle of pivotal movement. Furthermore, preferably, said fin-like shoe is exchangeably mountable to the at least one of the plurality of first elements.

Said fin-like shoe may comprise at its front end an exchangeably mounted cutting tip projecting in the direction of movement of the strand-like material laying device. Different cutting tips can be inserted in the shoe, for adaptation of the cutting and inserting elements to various different prevailing ground conditions.

Furthermore, at least one of the plurality of first elements, preferrably the first two of the plurality of first elements, may have at its blade nose an exchangeably mounted cutting tip projecting in the direction of movement of the strand-like material laying device. Different cutting tips can be inserted in the blade nose, for adaptation of the cutting and inserting elements to various different prevailing ground conditions.

The strand-like material laying device may further comprise a second unit for guiding said strand-like material into said trench and laying it at a bottom of said trench, which second unit is coupled to the first unit of first unit having said plurality of first elements, for pivotal movement about an axis which is substantially parallel to the depth direction of the strand-like material laying device. This second unit may comprise a plurality of second elements which are connected in series like a flexible chain, and wherein two successive ones of said plurality of second elements are coupled with each other for pivotal movement about an axis being substantially parallel to a depth direction of the strand-like material laying device, i.e. a substantially vertical axis, to allow for a compensation of lateral forces acting on the strand-like material laying device when ploughing the ground. This second unit is primarily for supporting the strand-like material laying device and serves to smoothly lay the strand-like material into the trench formed by the plurality of first elements.

The two successive ones of said plurality of second elements may further be coupled with each other at their bottom ends for pivotal movement about an axis which is substantially parallel to a width direction of the strand-like material laying device, to allow for an adaptation of the strand-like material laying device as a whole when crossing a hill or the like.

Preferably, a bottom end of said second unit is aligned with a bottom end of a trailing one of the first group of plurality of first elements in depth direction of the strand-like material laying device to form a substantially continuous sole (i.e., external bottom surface) for sliding on the base of the trench.

Furthermore, the strand-like material laying device according to the present invention may comprise an internal guiding channel extending continuously over the overall length of the strand-like material laying device from an inlet opening at a front end thereof towards an outlet opening at a rear end thereof, for guiding a strand-like material through the strand-like material laying device into a trench formed by the strand-like material laying device.

Taking account of maintaining a minimum allowable bending radius of the strand-like material to be laid the guiding channel is preferably formed along a curve having a radius of curvature which is set depending on a minimum allowable bending radius of the strand-like material to be laid in the trench.

Moreover, preferably, the inlet opening opens in a substantially horizontal direction for receiving a strand-like material lying on the ground ahead of the strand-like material laying device, and the outlet opening opens in a substantially horizontal direction on a level with the base of a trench formed by the strand-like material laying device. To enable a smooth feeding of the strand-like material through the internal guiding channel, the strand-like material laying device may have at its front end and rear end supporting rolls for supporting the strand like material fed into the inlet opening and out of the outlet opening, respectively.

Furthermore, a leading one of the first group of a plurality of first elements may comprise at its front end a towing eye for connecting to a towing rope, the towing eye being located beneath the inlet opening of the guiding channel. Therefore, according to an embodiment of the present invention the strand-like material laying device is pulled by means of the towing rope. Furthermore, according to an embodiment of the present invention, the towing eye may be located beneath the inlet opening of the guiding channel in order to cause a traction force transmitted by the towing rope to act directly at the strand-like material laying device at a position close to the ground.

Furthermore, another embodiment of the present invention provides an appliance for the subterranean laying of strand-like material, comprising a strand-like material laying device as above mentioned, and an off-road steerable chassis frame supporting the strand-like material laying device by straddling it between a pair of left wheels and the pair of right wheels and enabling to vertically lift and lower the strand-like material laying device from and towards the ground, respectively.

The chassis frame may be of the articulated frame type having a central structural framework which is supported on four wheels by means of an articulating linkage assembly associated with each wheel and the framework.

Preferably, the strand-like material laying device is connected at its front end side to the central structural framework for pivotal movement about an axis being substantially parallel to a width direction of the strand-like material laying device, and is coupled at its rear end side to means for vertically lifting and lowering the strand-like material laying device, which means is vertically slidably supported by the central structural framework.

BRIEF DESCRIPTION OF THE DRAWINGS

The accompanying drawings, where like numerals indicate like components, illustrate a preferred embodiment of the invention.

FIGS. 9*a*, 9*b*, 9*c*, 10*a* and 10*b* illustrate guiding means on an internal guiding channel in order to obtain a smooth guidance of the strand-like material through the internal guiding channel.

DETAILED DESCRIPTION OF THE PREFERRED EMBODIMENTS

Reference will now be made with FIGS. 1 to 10 to the structure and effects of preferred embodiments of the invention.

Referring to FIGS. 1 to 10, the ground surface is denoted by GS, the ground is denoted by G, a trench formed by a strand-like material laying device according to the present invention is denoted by T, and a strand-like material laid in the trench T is denoted by M. Arrows L, D, and W denote a longitudinal direction (or direction of movement), a depth direction, and a width direction (or lateral direction), respectively, of the strand-like material laying device 10.

Figure 1:
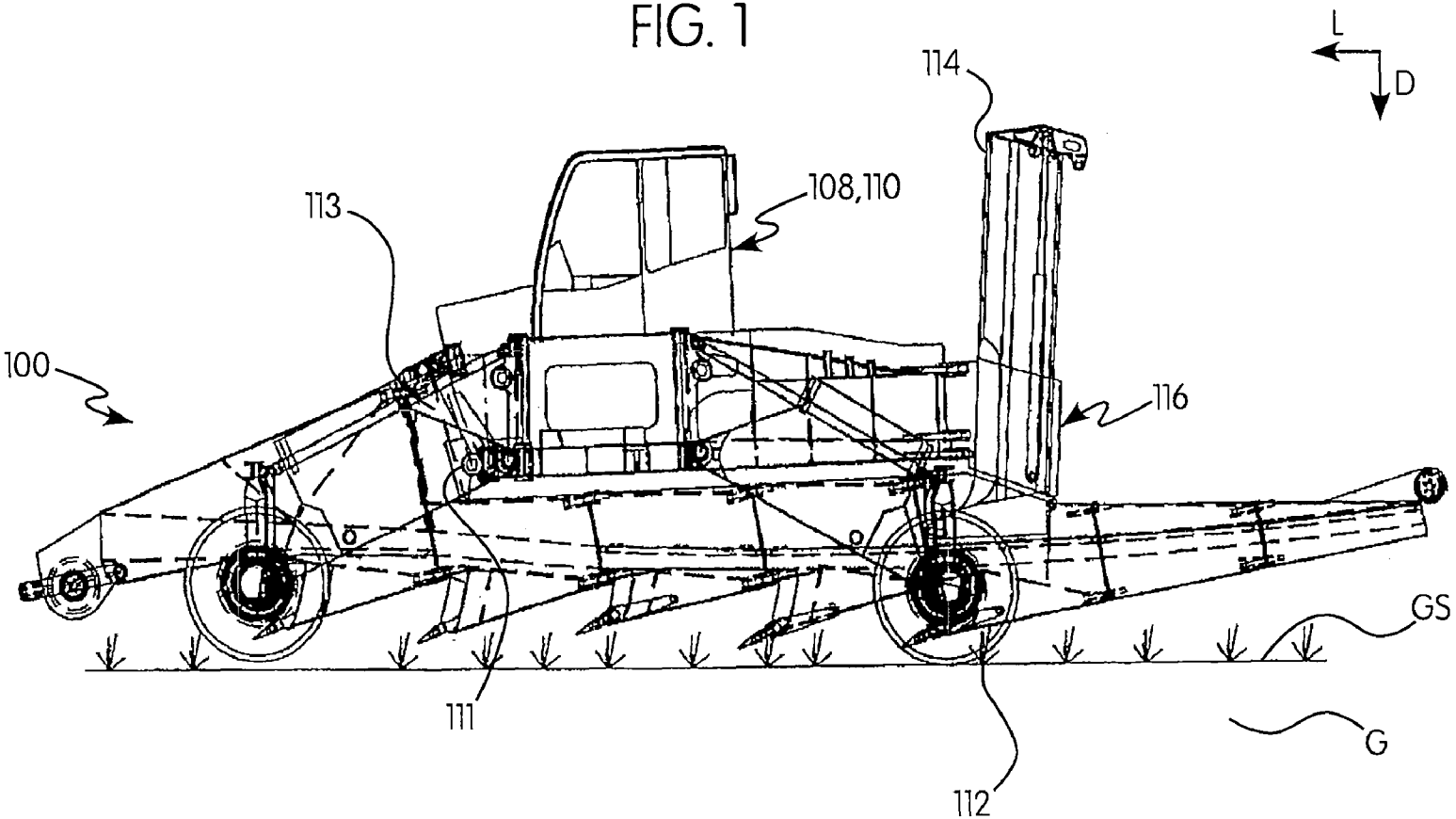
FIG. 1 is a side view schematically showing an appliance carrying a strand-like material laying device according to an embodiment of the present invention.
Figure 2:
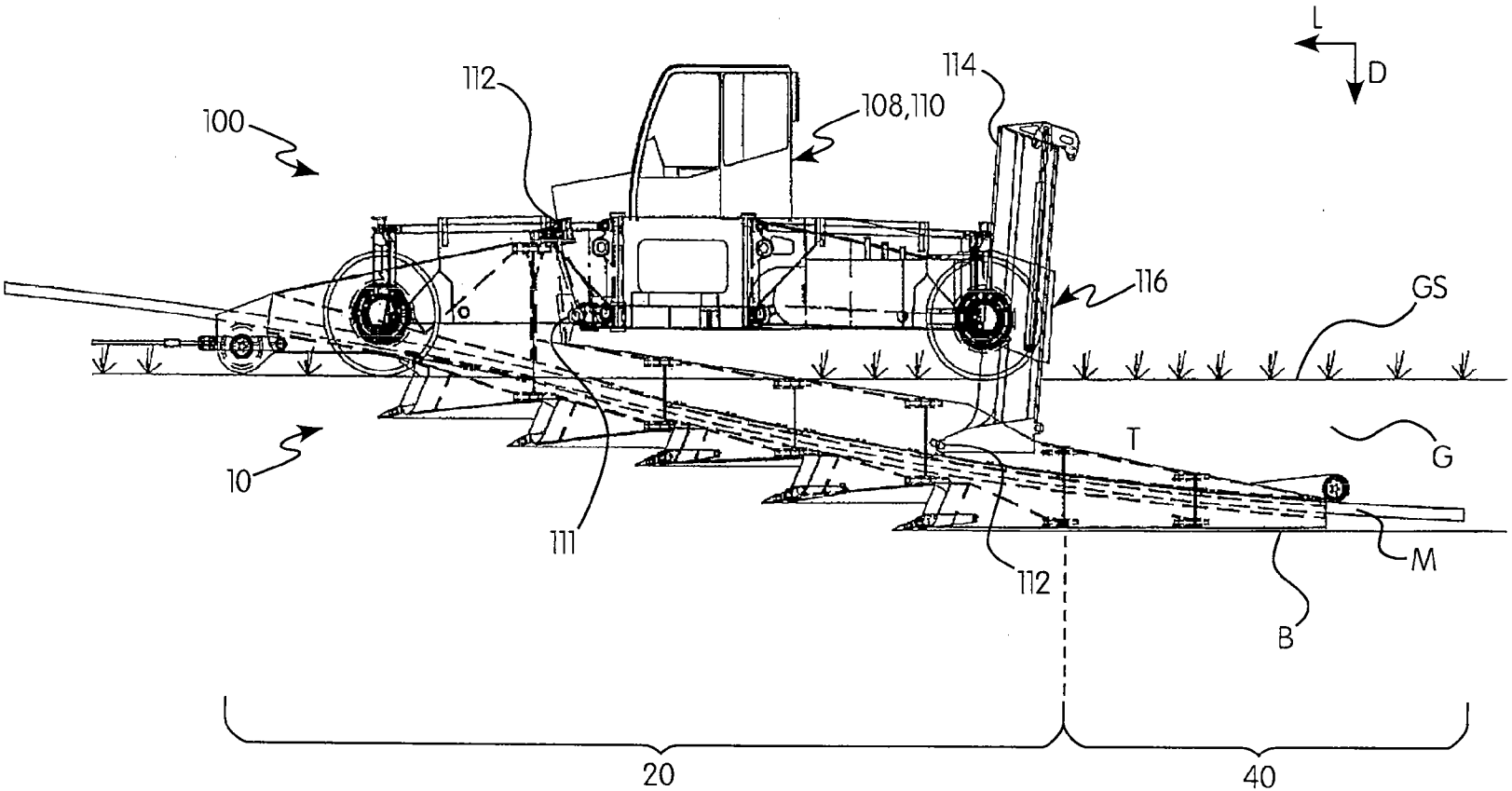
FIG. 2 is a side view schematically showing the appliance of FIG. 1 in a state where the strand-like material laying device according to an embodiment of the present invention is immersed into the ground.
Figure 3:
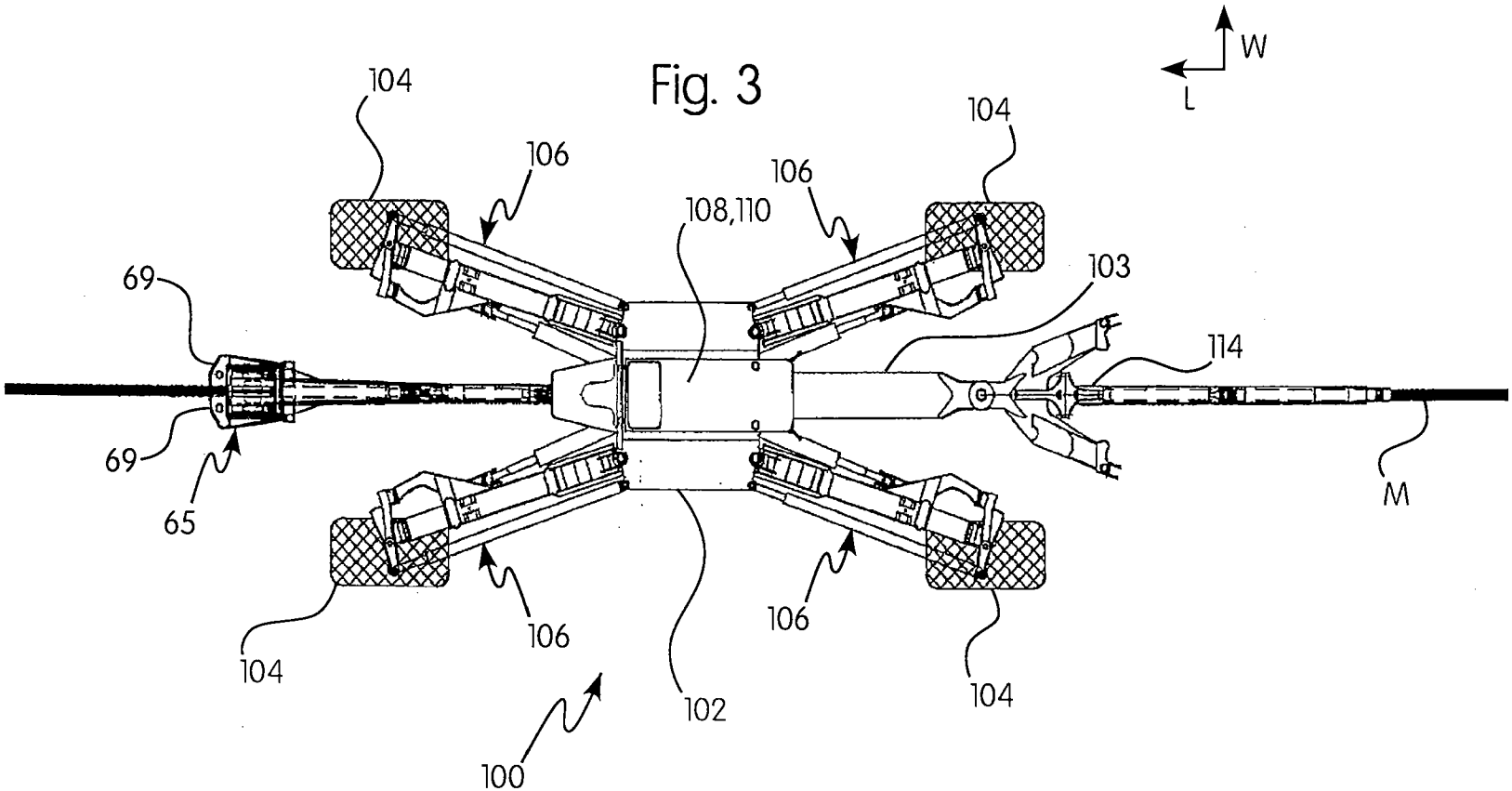
FIG. 3 is a top view schematically showing the appliance of FIG. 1.

FIGS. 1 to 10 show a strand-like material laying device 10 according to an embodiment of the present invention, which is carried by an off-road steerable, four-wheeled chassis frame 100 as seen from FIGS. 1 to 3. As it is illustrated in FIG. 2, the strand-like material laying device 10 carried by the chassis frame 100 is configured to substantially vertically immerse into the ground G when being moved or pulled in the longitudinal direction L, thereby to excavate or cut the ground G and form a trench T, to smoothly feed the strand-like material M, such as a steel pipe, cable, etc., from the ground G over its entire length into the thus formed trench T and to smoothly lay it onto a base B of the thus formed trench T.

The chassis frame 100 as depicted in FIGS. 1 to 3 generally includes a central structural framework 102 which is supported on four wheels 104 by means of an articulating linkage assembly 106 associated with each wheel 104 and central structural framework 102. The central structural framework 102 may serve as a support for a cabin 108 and/or power section 110 depicted in FIGS. 1 to 3 and a control box not shown. Other items, such as body, driver's seat, etc. (not shown) may be supported on frame in a conventional manner. The articulating linkages 106 are configured to move the four wheels 104 independently from each other in both horizontal and vertical directions with respect to the chassis frame 100.

An example of a possible chassis frame 100 is SpiderPlow used by SpiderPlow Services a specialized pipeline installation company, operating in western Canada and the United States, and engineered and manufactured in Germany by Walter Föckersperger GmbH. Technical details of the chassis frame 100 and linkages 106 can be obtained from SpiderPlow Services or Walter Föckersperger GmbH, Germany.

Figure 4A:
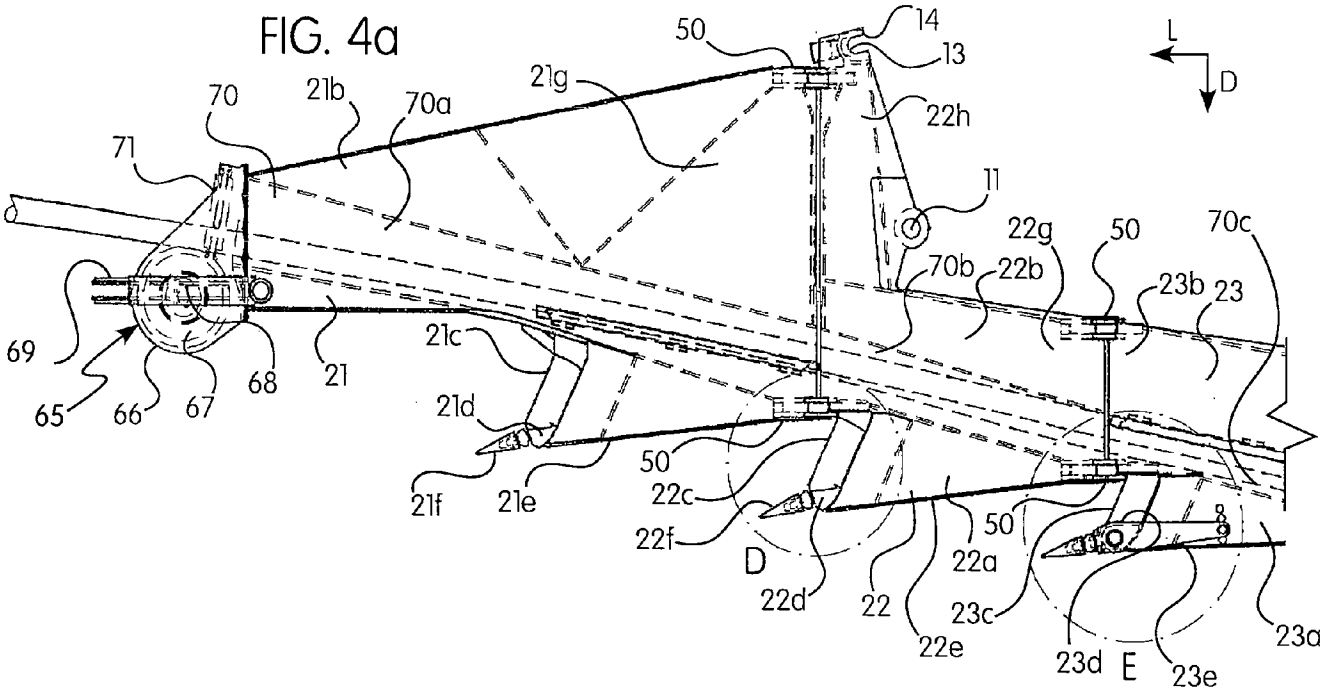
FIGS. 4*a* and 4*b* are side views showing the strand-like material laying device according to an embodiment of the present invention.
Figure 5A:
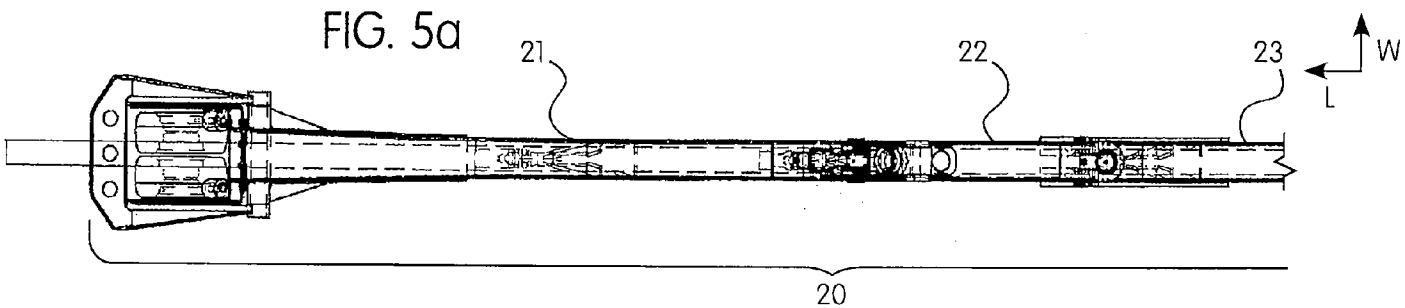
FIGS. 5*a* and 5*b* are top views showing the strand-like material laying device according to an embodiment of the present invention.
Figures 4B, 5B:
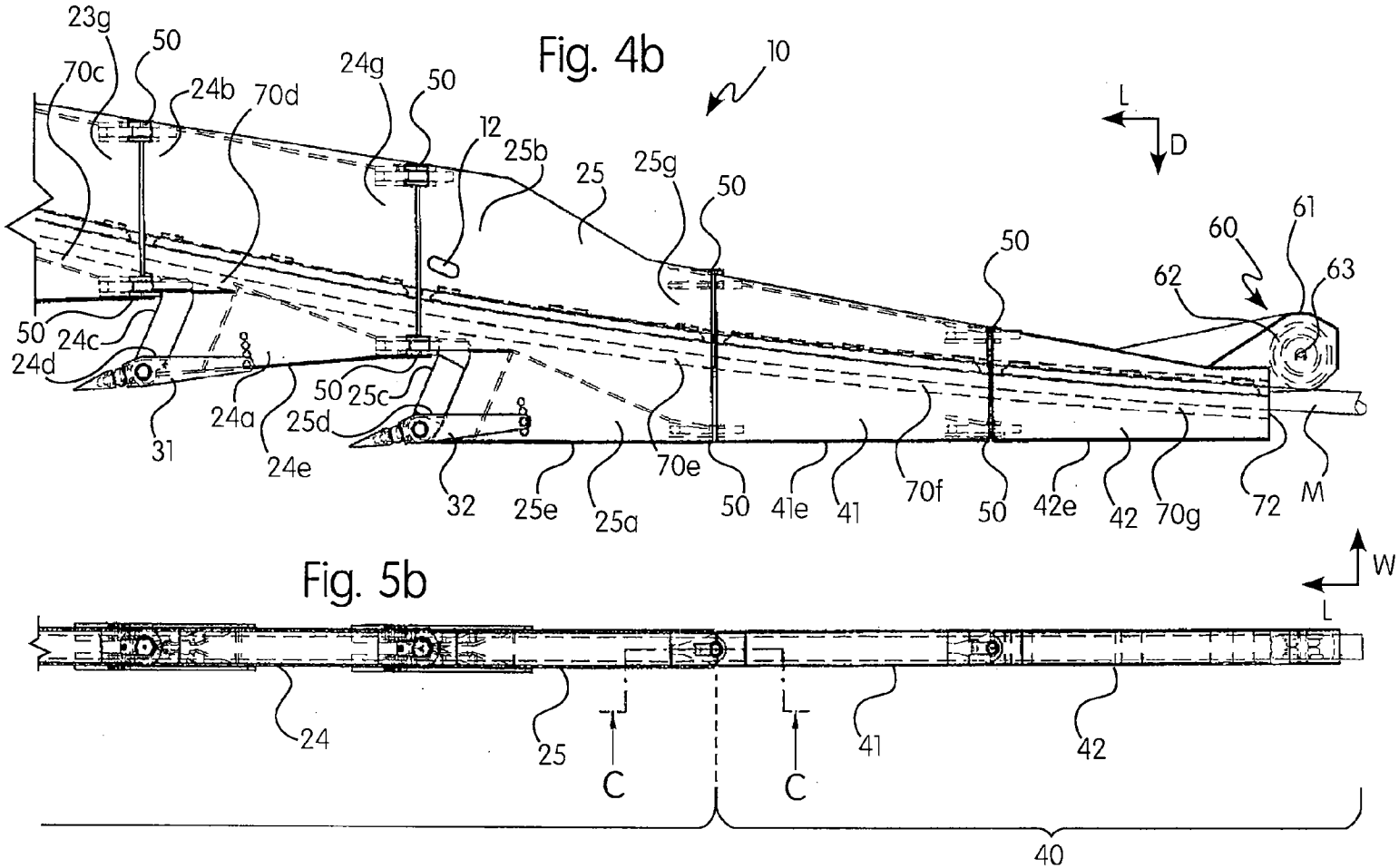

As it is seen from FIGS. 1, 2 and 3, the strand-like material laying device 10 is supported astraddle by the chassis frame 100 between the pair of left wheels and the pair of right wheels. More specifically, the strand-like material laying device 10 is attached to the chassis frame 100 via support bolts which extend in width direction W through support holes 11, 12, 13 provided at the strand-like material laying device 10, as shown in FIGS. 4*a* and 4*b*, and are held at support portions 111, 112, 113 provided at the chassis frame 100. As illustrated in FIGS. 1 and 2 a first support portion 111 is provided at a front end side of the central structural framework 102, while a second support portion 112 is provided at a blade means 114 which is supported at a rear end side of a longitudinal direction extension 103 of the central structural framework 102 by means of a hydraulically operated lifting equipment 116. An additional third support portion 113 is provided at a front end side of the central structural framework 102 at a predetermined distance above the first support portion 111. While the first and second support portions 111, 112 have the function to pivotally carry the strand-like material laying device 10 on the chassis frame 100, the third support portion 113 is primarily for supporting the strand-like material 10 in width direction W in order to prevent the strand-like material laying device 10 from tilting with respect to the chassis frame 100 about a longitudinal axis.

By simultaneously operating the articulating linkages 106 and the lifting equipment 116 the strand-like material laying device 10 carried by the chassis frame 100 can be moved in the depth direction D, i.e., can be lowered to immerse into the ground G as shown in FIG. 2, or lifted out of the ground G as shown in FIG. 1.

While in operation, the strand-like material laying device 10 can be divided in longitudinal direction L in a front or first unit 20 and a rear or second unit 40 as shown in FIG. 2. Referring to FIG. 2, the first unit 20 has the primary function of cutting the ground G and forming the trench T having substantially vertical side walls and a base B in a predetermined depth defined by the depth of immersion of the strand-like material laying device 10, and internally feeding the strand-like material M lying on the ground surface GS in front of the strand-like material laying device 10 into the trench T when being moved in the longitudinal direction L. The second unit 40 has the primary function of internally feeding and smoothly laying the strand-like material M onto the base B of the thus formed trench T. When being immersed into the ground G by means of lowering the central structural framework 102 and blade means 114, and being moved in the longitudinal direction L both the first unit 20 and the second unit 40 will align themselves in a substantially vertical direction due to side forces laterally acting from the vertical side walls of the trench T onto the strand-like material laying device 10. In summary, the first unit 20 and the second unit 40 of the strand-like material laying device 10 cooperate to form a substantially trench T in the ground G and to act like a chute to smoothly feed and lay a strand-like material M from the ground surface GS towards the base B of trench T.

As can be best seen from FIGS. 4*a*, 4*b*, 5*a* and 5*b*, the first unit 20 and the second unit 40 are each formed of a plurality of first elements, more specifically five first elements 21, 22, 23, 24, 25, and a plurality of second elements, more specifically two second elements 41, 42, respectively, which are connected to each other in series like a flexible chain. While the first elements 21, 22, 23, 24, 25 are pivotally coupled with each other about an axis which is substantially parallel to the depth direction D, the second elements 41, 42 are pivotally coupled with each other and with the last one 25 of the first elements 21, 22, 23, 24, 25 about an axis which is substantially parallel to the depth direction D and an axis which is substantially parallel to the width direction W.

Each of the plurality of first and second elements is formed of steel plates to have a hollow rigid configuration which is closed at the left and right side walls, at the bottom and top sides, and at the front and rear sides except where a later discussed internal guiding channel 70 enters and exits. A width of each of the plurality of first and second elements is set so that the internal guiding channel 70 can be formed to feed the strand-like material M internally through the strand-like material laying device 10 as illustrated in FIGS. 2, 4*a* and 4*b*.

The five elements 21, 22, 23, 24, 25 of the first unit 20 are each structured to have a depth directional lower front end portion 21*a*, 22*a*, 23*a*, 24*a*, 25*a* and a depth directional upper front end portion 21*b*, 22*b*, 23*b*, 24*b*, 25*b*.

The lower front end portions 21*a*, 22*a*, 23*a*, 24*a*, 25*a* taper off in longitudinal direction L to define each a cutting edge 21*c*, 22*c*, 23*c*, 24*c*, 25*c* at their front ends as can be best seen from FIGS. 5*a*, 5*b*, 7*a* and 8*c*. As shown in FIGS. 1, 2, 4*a* and 4*b*, elements 21, 22, 23, 24, 25 are staggered with respect to each other in depth direction D of the strand-like material laying device 10 so that the lower front end portions 21*a*, 22*a*, 23*a*, 24*a*, 25*a* and thus the cutting edges 21*c*, 22*c*, 23*c*, 24*c*, 25*c* of respective two successive ones of the five elements 21, 22, 23, 24, 25, i.e. cutting edges 21*c*, 22*c* of elements 21, 22, cutting edges 22*c*, 23*c* of elements 22, 23, cutting edges 23*c*, 24*c* of elements 23, 24, and cutting edges 24*c*, 25*c* of elements 24, 25, are offset with respect to each other in depth direction D of the strand-like material laying device 10. Accordingly, a working depth of elements 21, 22, 23, 24, 25 increases in a direction opposed to the longitudinal direction L of the strand-like material laying device 10. As it is seen from FIGS. 4*a* and 4*b*, the cutting edges 21*c*, 22*c*, 23*c*, 24*c*, 25*c* of elements 21, 22, 23, 24, 25 are formed so as to be inclined slightly downward from the horizontal direction, terminate at a front bottom end portion in a nose portion 21*d*, 22*d*, 23*d*, 24*d*, 25*d* and project forward in the longitudinal direction L. Cutting edges 21*c*, 22*c*, 23*c*, 24*c*, 25*c* may be fixed to the front ends of elements 21, 22, 23, 24, 25, e.g. by welding. Alternatively, cutting edges 21*c*, 22*c*, 23*c*, 24*c*, 25*c* may be exchangeably mounted to the front ends of elements 21, 22, 23, 24, 25, e.g. by way of positive locking and bolting.

Moreover, as it is seen from FIGS. 4*a* and 4*b* the soles (i.e., the external bottom surfaces) 21*e*, 22*e*, 23*e*, 24*e* of each element 21, 22, 23, 24 are inclined in a rear-and-upward direction to define a clearance angle $\alpha$ between soles 21*e*, 22*e*, 23*e*, 24*e* and the longitudinal direction L when cutting the ground G. A sole 25*e* of element 25 extends in a direction substantially parallel with the longitudinal direction L to smoothly transition to a soles 41*e*, 42*e* of elements 41, 42 of the second unit 40.

Figures 7A, 7B, 8A, 8B, 8C, 8D:
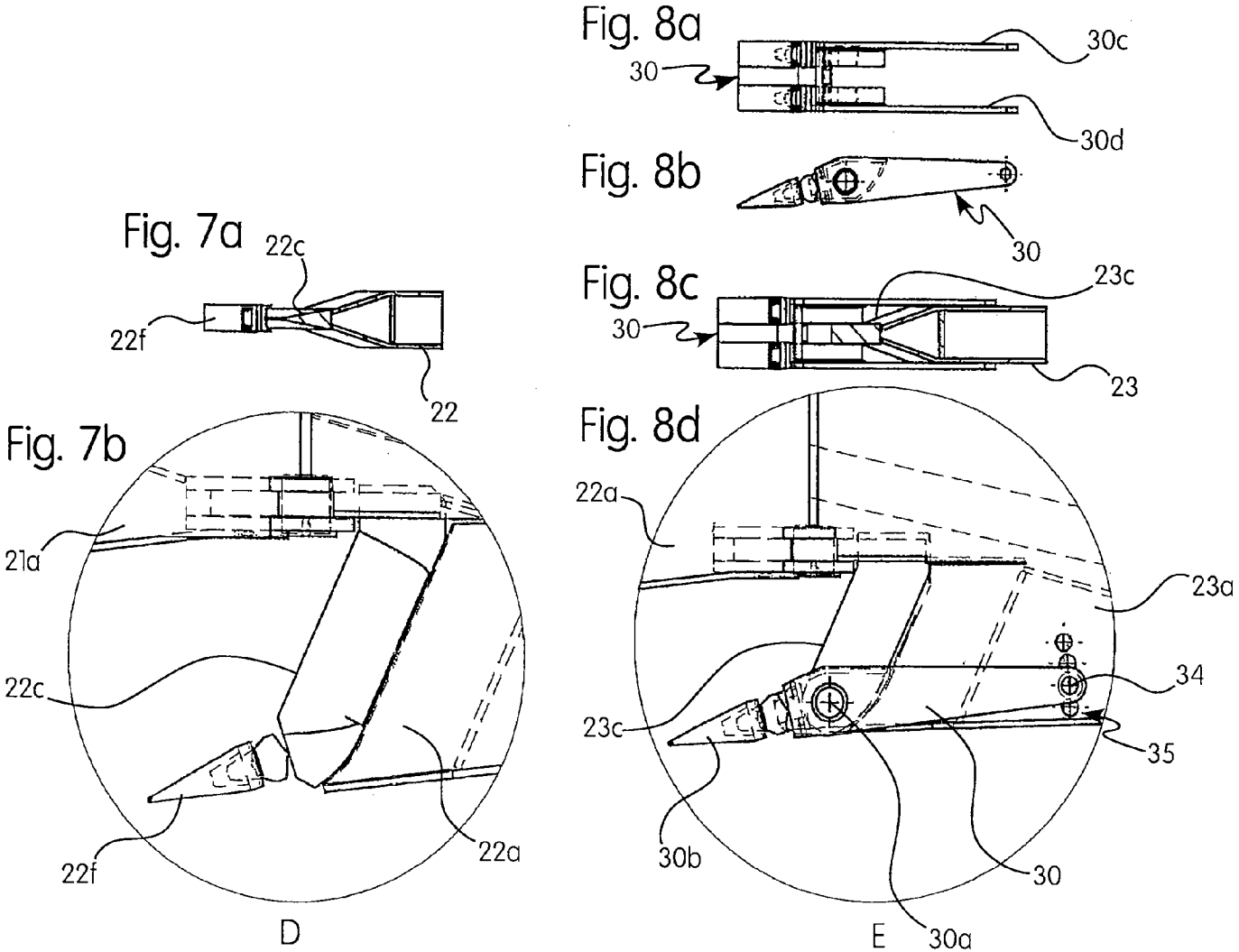
FIGS. 7*a* and 7*b* are top and partial side views schematically showing a lower portion of a single element of the strand-like material laying device.
FIGS. 8*a* and 8*b* are top and partial side views schematically showing a fin-like shoe to be attached to a lower portion of another single element of the strand-like material laying device.
FIGS. 8*c* and 8*d* are top cross-sectional and partial side views schematically showing the fin-like shoe of FIGS. 8*a* and 8*b* in a state attached to a lower portion of the another single element of the strand-like material laying device.

Elements 21, 22 each comprise, as means for controlling the working depth thereof, an exchangeably mounted chisel-like cutting tip 21*f*, 22*f* projecting in the direction of movement of the strand-like material laying device 10. Cutting tips 21*f*, 22*f* are screwed onto noses 21*d*, 22*d* about a longitudinal direction thereof. FIGS. 7*a* and 7*b* illustrate in more detail the cutting edge portion of element 22. The structure of the cutting edge portion of element 21 may be similar to that of element 22, so a further description thereof is omitted.

As opposed to elements 21, 22, elements 23, 24, 25 each comprise, as means for controlling the working depth thereof, a fin-like shoe 30, 31, 32 coupled to respective noses 23*d*, 24*d*, 25*d* for pivotal movement about an axis being parallel with respect to the width direction W of the strand-like material laying device 10. FIGS. 8*a* and 8*b* illustrate in more detail the structure of the fin-like shoe 30, while FIGS. 8*c* and 8*d* illustrate in more detail the cutting edge portion of element 23 having the fin-like shoe 30. As follows from FIGS. 8*a*, 8*b* and 8*c*, fin-like shoe 30 has a U-shaped structure comprising two rearwardly extending leg portions 30*c*, 30*d* that are disposed laterally outside the side walls of element 23 to partially embrace element 23, and a cutting tip 30*b* exchangeably mounted to a front part of the U-shade structure as a means for controlling the working depth of element 23. Cutting tip 30*b* is screwed onto the nose 23*d* about a longitudinal direction thereof. The fin-like shoe 30 is supported at nose portion 23*d* like a lever for pivotal movement about an axis 30*a* being substantially parallel with respect to the width direction W of the strand-like material laying device 10. As it is illustrated in FIG. 8*d* a relative angular position of the fin-like shoe 30 with respect to element 23 can be adjusted within a predetermined range of pivotal movement at various positions defined by bolt inserting holes 35 provided at the element 23, by inserting a bolt 34 through bolt inserting holes 35 formed at a rear portion of leg portions 30*c*, 30*d* and an appropriate one of bolt inserting holes 35 formed at element 23. A relative angular position of the fin-like shoe 30 with respect to the element 23 is set depending on the constitution of the ground. In a not shown alternative embodiment the rearward extending leg portions 30*c*, 30*d* may be hingedly coupled with a control mechanism (e.g., a hydraulically operated control mechanism) allowing to continuously pivot the fin-like shoe 30 within a predetermined range of pivotal movement during operation of the strand-like material laying device, Since the structure of the cutting edge portions of elements 24, 25 and fin-like shoes 31, 32 correspond to that of element 23 and fin-like shoe 30, a further description thereof is not included.

A supporting mechanism 65 for the strand-like material M is attached, e.g. bolted, to the front end upper portion 21*b* of element 21, as it is seen from FIG. 4*a*. The supporting mechanism 65 includes a housing 66 and a supporting roll 67 which is supported for rotation about an axis 68 being substantially parallel with respect to the width direction W, by the housing 66. Moreover, as it is seen from FIG. 3, a row of three towing eyes 69 may be provided in width direction W at a front end of the supporting mechanism 65 for connecting the strand-like material laying device 10 to a towing rope (not shown).

Figures 6A, 6B, 6C:
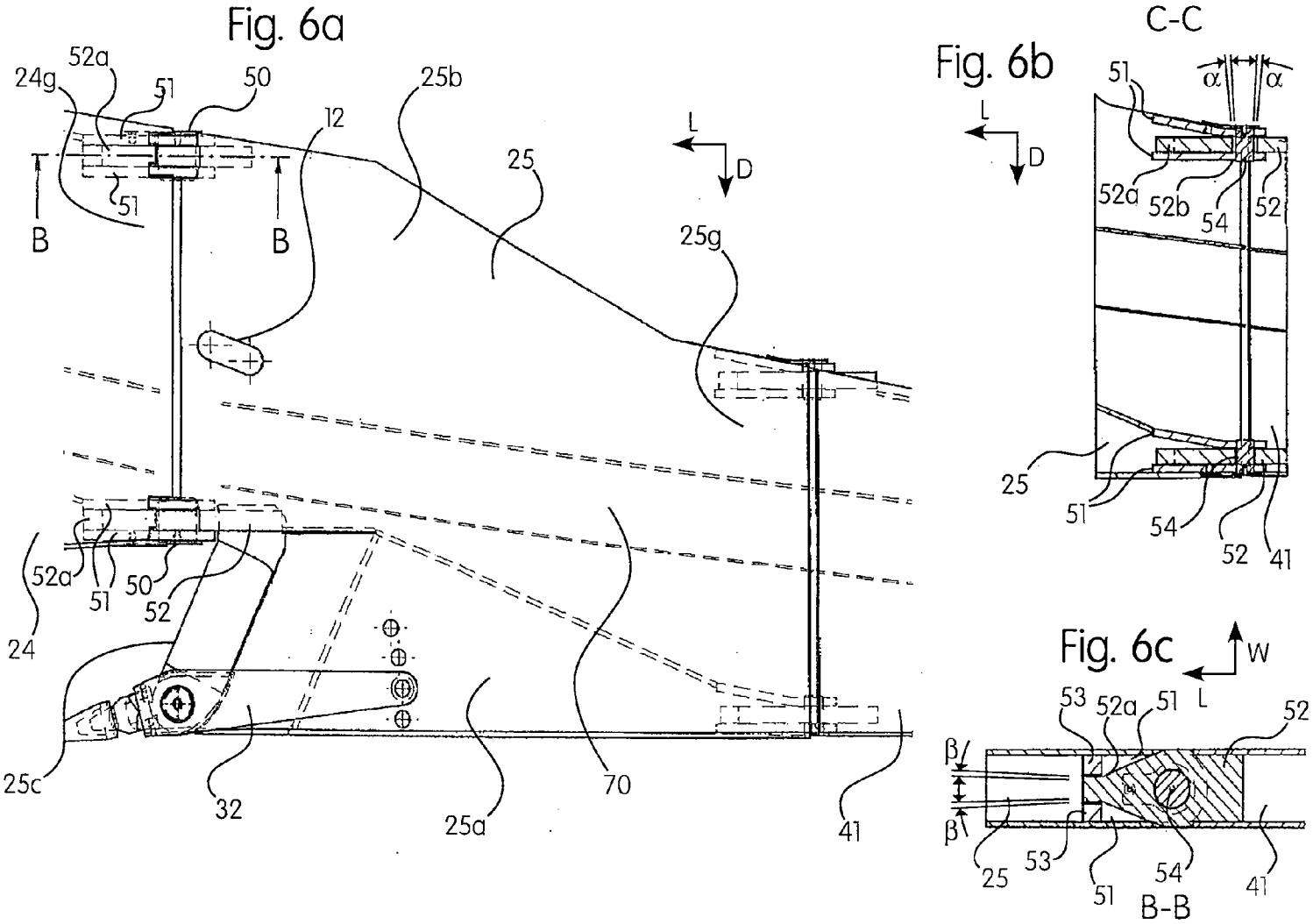
FIG. 6*a* is a side view schematically picking out a single element of the strand-like material laying device according to an embodiment of the present invention.
FIG. 6*b* is a cross-sectional side view schematically showing a coupling portion of two elements of the strand-like material laying device along a dashed line A-A in FIG. 5*b*.
FIG. 6*c* is a cross-sectional top view schematically showing an upper hinge of the coupling portion shown in FIG. 6*b*.

The upper front end portions 22*b*, 23*b*, 24*b*, 25*b* of elements 22, 23, 24, 25 which are located behind the first or leading element 21 are each coupled with a rear end of a respectively preceding one of elements 21, 22, 23, 24 for a limited pivotal movement about an axis being substantially parallel with the depth direction D of the strand-like material laying device 10. More specifically, as illustrated in FIGS. 4*a* and 4*b* the rear end portions 21*g*, 22*g*, 23*g*, 24*g* of elements 21, 22, 23, 24 are each coupled with the upper front end portions of elements 22, 23, 24, 25 by a pair of upper and lower hinges 50. As illustrated by FIG. 6*a* these hinges 50 include each a pair of lugs 51 which extend rearwardly from a rear end portions 21*g*, 22*g*, 23*g*, 24*g* of elements 21, 22, 23, 24 and carry a bolt-like hinge pin 54 illustrated in FIG. 6*b*, extending substantially in the depth direction D of the strand-like material laying device 10. The upper front end portions 22*b*, 23*b*, 24*b*, 25*b* of elements 22, 23, 24, 25 are each provided with upper and lower forwardly extending lugs 52 which are each sandwiched between a corresponding one of the pairs of rearwardly extending lugs 51 and have a hinge pin accommodating bore through which a corresponding one of the hinge pins 54 passes for a sliding motion. Each of the pairs of rearwardly extending lugs 52 includes a means of abutment 53 for a front end 52*a* of the forwardly extending lug 52 if a predetermined angle of pivotal movement β about an axis defined by hinge pin 54 is exceeded in clockwise or anti-clockwise direction. As for the structure of the hinges 50 it is referred to FIGS. 6*b* and 6*c* showing a structure of hinges 50 for coupling elements 41 and 25, which structure corresponds in principle to that of the hinges 50 for coupling elements 21, 22, 23, 24, 25. The rearwardly extending lugs 51, the hinge pins 54, and the forwardly extending lugs 52 thus form hinges 50 between two successive ones of elements 21, 22, 23, 24, 25 (as well as between elements 41, 42) which allow a pivotal movement about an axis which is defined by hinge pin 54 to a limited extent, e.g. by ±1 degree.

A rear end upper portion 22*h* of element 22 and the front end upper portion 25*b* of element 25 are provided with support holes 11, 12 for pivotally attaching the strand-like material laying device 10 to the chassis frame 100. Moreover, the rear end upper portion 22*h* of element 22 provides at a distance above the support hole 11 an elongated bore 13 for the accommodation of a front end portion of a not depicted sliding rod which is pivotally attached at its other end portion at the chassis frame 100. To fix the strand-like material laying device 10 in the transport position shown in FIG. 1 there is further provided a cross-hole 14 crossing the elongated bore 13 and positively engaging with a not depicted bolt provided at the chassis frame 100 in the transport position to prevent the strand-like material laying device 10 from laterally tilting with respect to the chassis frame 100, during a transport thereof.

As can be best seen from FIGS. 4*b* and 5*b*, the second unit 40 is formed of elements 41, 42 which are connected to each other in series like a flexible chain. As opposed to the first elements 21, 22, 23, 24, 25 which are pivotally coupled with each other only about an axis which is substantially parallel to the depth direction D, the second elements 41, 42 are pivotally coupled with each other and with the last one 25 of the first elements 21, 22, 23, 24, 25 about both an axis which is substantially parallel to the depth direction D and an axis which is substantially parallel to the width direction W. Hinges 50 pivotally coupling elements 41, 42 with each other and element 41 with element 25 differ from hinges 50 between elements 21, 22, 23, 24, 25 only in the following feature. The upper forwardly extending lugs 52 of elements 41 and 42 comprise each instead of a round hinge pin accommodating bore an elongated hinge pin accommodating hole 52*b* extending in the longitudinal direction L as illustrated in FIG. 6*b*. Accordingly, the hinge pins 54 can slide within the hinge pin accommodating holes 52*b* provided at the upper forwardly extending lugs 52*b* of elements 41, 42 in longitudinal direction L. On the other hand, the lower forwardly extending lugs 52 of elements 41 and 42 comprise each a hinge pin accommodating bore similar to the upper and lower forwardly extending lugs 52 of elements 21, 22, 23, 24, 25, in which the hinge pins 54 are accommodated with a small play only sufficient to enable the hinge pins 54 to slightly incline within the hinge pin accommodating bores. Therefore, an axis for a pivotal movement of elements 41, 42 with respect to elements 25, 41, respectively, is provided at the interface of bottom ends of elements 41, 25 and 41, 42, which is substantially parallel to the width direction W. Moreover, a pivotal movement of elements 41, 42 with respect to elements 21, 41, respectively, is limited by the length of the elongated hinge pin accommodating hole 52*b* provided in the upper forwardly extending lugs 52*b* of elements 41, 42 to a predetermined angle of pivotal movement a which is e.g. 1 to 10 degrees.

As can be seen from FIGS. 4*a* and 4*b* elements 41 and 42 are aligned with each other and with respect to element 25 in depth direction D so that their bottom ends 41*e*, 42*e* are on substantially the same level with a bottom end of element 25.

A supporting mechanism 60 for the strand-like material M is attached, e.g. bolted, to the rear end upper portion 42*g* of element 42 as it is seen from FIG. 4*b*. The supporting mechanism 60 includes a supporting housing 61 and a supporting wheel 62 which is supported for rotation about an axis 63 being substantially parallel with respect to the width direction W, by the supporting housing 61.

Furthermore, the strand-like material laying device 10 comprises an internal guiding channel 70 which is constituted by guiding channel portions 70*a*, 70*b*, 70*c*, 70*d*, 70*e*, 70*f*, 70*g* each being provided in one of elements 21, 22, 23, 24, 25, 41, 42 so as to extend continuously over the overall length of the strand-like material laying device 10 from an inlet opening 71 at a front end of element 21, which is located immediately above the supporting mechanism 65, thereof towards an outlet opening 72 at a rear end of element 42, which is located immediately below the supporting mechanism 60, as seen from FIGS. 4*a* and 4*b*, for guiding the strand-like material M through the strand-like material laying device 10 into the trench T. Taking account of maintaining a minimum allowable bending radius of the strand-like material T the guiding channel 70 is formed through the strand-like material laying device 10 along a smoothly bent curve having a radius of curvature R which is set depending on a minimum allowable bending radius of the strand-like material T.

As it is seen from FIG. 4 the inlet opening 71 is set so as to open in a substantially horizontal direction for receiving the strand-like material T laying on the ground G ahead of the strand-like material laying device 10, and the outlet opening 72 opens in a substantially horizontal direction on a level with the base B of the trench T formed by the strand-like material laying device 10.

Figures 9B, 9C, 10A, 10B:
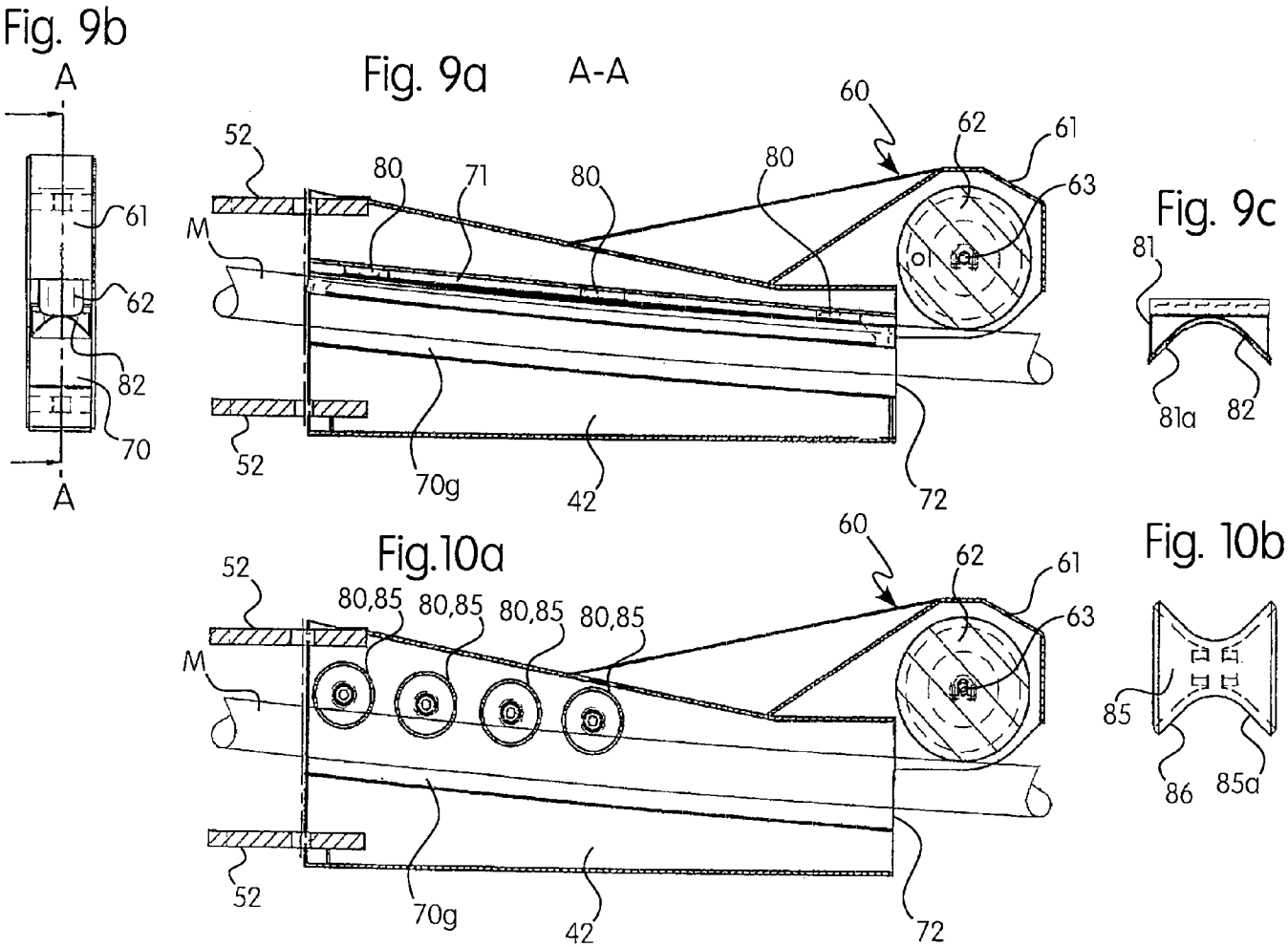

Furthermore, in order to obtain a smooth guidance of the strand-like material M through the internal guiding channel 70 portions the internal guiding channel 70 expected to be in friction with the strand like material may be provided with guiding means 80 as shown in FIGS. 9*a*, 9*b*, 9*c*, 10*a*, 10*b*. Albeit such means are shown in combination with element 42 only, such means may be provided at any other friction portions as well, e.g. at any portions where the strand-like material M comes into contact with the sidewalls defining the internal guiding channel 70. These guiding means 80 may include supporting members 81 which are attached via an elastically deformable material 81*b*, e.g. a rubber material, at an upper side wall 71 of the internal guiding channel portions 70*a*, 70*b*, 70*c*, 70*d*, 70*e*, 70*f*, 70*g* of the corresponding one of elements 21, 22, 23, 24, 25, 41, 41, and have a curved surface 81*a* which is provided with a low friction coating 82 to support the strand-like material M as illustrated in FIG. 9*a*. Alternatively, these guiding means 80 may include supporting rolls 85 which are each rotatably held by the corresponding one of elements 21, 22, 23, 24, 25, 41, 41, and have a curved surface 85*a* which is provided with an elastic deformable coating 86 to support the strand-like material M as illustrated in FIG. 10*b*.

Although the present invention has been described in connection with a specific preferred embodiment for instructional purposes, the present invention is not limited thereto. Accordingly, various modifications, adaptations, and combinations of various features of the described embodiments can be practiced without departing from the scope of the invention as set forth in the claims.

What is claimed is:

1. A strand-like material laying device for immersing into the ground to form a subterranean trench while being moved in a longitudinal direction, said strand-like material laying device comprising:

a first unit for cutting the ground to form said trench and guiding a strand-like material into said trench, said first unit having a plurality of first elements which are connected in series like a flexible chain and each of which has at its front end a cutting edge wherein the cutting edges of two successive ones of the plurality of first elements are offset with respect to each other in depth direction of the strand-like material laying device so that a cutting depth of the strand-like material laying device increases in a direction 180 degrees opposed to a direction of movement thereof, and wherein said two successive ones of the plurality of first elements are coupled with each other for pivotal movement relative to each other about an axis being substantially parallel to the depth direction of the strand-like material laying device.

2. The strand-like material laying device according to claim 1, wherein a pivotal movement of said two successive ones of the plurality of first elements is limited to a predetermined angle of pivotal movement.

3. The strand-like material laying device according to claim 2, wherein said angle of pivotal movement of said two successive ones of the plurality of first elements is adjustably set on the basis of the type of strand-like material to be laid into the trench formed in the ground.

4. The strand-like material laying device according to claim 2, wherein said angle of pivotal movement is limited to be within a range of 1 and 3 degrees.

5. The strand-like material laying device according to claim 1, wherein the cutting edges are exchangeably mounted to the plurality of first elements.

6. The strand-like material laying device according to claim 1, wherein each of the cutting edges is inclined downward from a horizontal level and terminates at its bottom end in a nose projecting in the direction of movement of the strand-like material laying device.

7. The strand-like material laying device according to claim 6, wherein at least one of the plurality of first elements has as means for controlling a working depth thereof, a fin-like shoe coupled to said nose for pivotal movement about an axis which is substantially perpendicular with respect to the depth direction and direction of movement of the strand-like material laying device.

8. The strand-like material laying device according to claim 7, wherein a pivotal movement of said fin-like shoe is limited to a predetermined angle of pivotal movement.

9. The strand-like material laying device according to claim 7, wherein said fin-like shoe is exchangeably mounted to the at least one of the plurality of first elements.

10. The strand-like material laying device according to claim 7, wherein said fin-like shoe comprises at its front end an exchangeably mounted cutting tip projecting in the direction of movement of the strand-like material laying device.

11. The strand-like material laying device according to claim 6, wherein at least one of the plurality of first elements has at its nose an exchangeably mounted cutting tip projecting in the direction of movement of the strand-like material laying device.

12. The strand-like material laying device according to claim 1, comprising a second unit for guiding said strand-like material into said trench and laying said strand-like material at a bottom of said trench, which second unit is coupled to the first unit having said plurality of first elements, for pivotal movement about an axis which is substantially parallel to the depth direction of the strand-like material laying device.

13. The strand-like material laying device according to claim 12, wherein said second unit comprises a plurality of second elements which are connected in series like a flexible chain, and wherein two successive ones of said plurality of second elements are coupled with each other for pivotal movement about an axis being substantially parallel to the depth direction of the strand-like material laying device.

14. The strand-like material laying device according to claim 13, wherein the two successive ones of said plurality of second elements are further coupled with each other for pivotal movement about an axis which is substantially parallel to a width direction of the strand-like material laying device.

15. The strand-like material laying device according to claim 12, wherein a bottom end of said second unit is aligned with a bottom end of a trailing first element of said plurality of first elements in the depth direction of the strand-like material laying device to form a substantially continuous sole for sliding on a base of the trench.

16. The strand-like material laying device according to claim 1, comprising an internal guidance extending continuously over an overall length of the strand-like material laying device from an inlet opening at a front end thereof towards an outlet opening at a rear end thereof, for guiding the strand-like material into said trench.

17. The strand-like material laying device according to claim 16, wherein a guiding channel is formed along a curve having a radius of curvature which is set depending on a minimum allowable bending radius of the strand-like material to be laid in the trench.

18. The strand-like material laying device according to claim 16, wherein the inlet opening opens in a substantially horizontal direction for receiving a strand-like material laying on the ground ahead of the strand-like material laying device, and the outlet opening opens in a substantially horizontal direction on a level with a base of said trench formed by the strand-like material laying device.

19. The strand-like material laying device according to claim 18, comprising at its front end and rear end supporting rolls for supporting the strand-like material fed into the inlet opening and out of the outlet opening, respectively.

20. The strand-like material laying device according to claim 16, wherein a leading first element of said plurality of first elements comprises at its front end a towing eye for connecting to a towing rope, the towing eye being located beneath the inlet opening of a guiding channel.

21. An appliance for the subterranean laying of strand-like material, comprising:

a strand-like material laying device for penetrating the ground to form a subterranean trench while being moved over the ground, said strand-like material laying device comprising a first unit for cutting the ground to form said trench and guiding said strand-like material into said trench, said first unit having a plurality of first elements which are connected in series like a flexible chain and each of said plurality of first elements has at its front end a cutting edge wherein the cutting edges of two successive ones of the plurality of first elements are offset with respect to each other in depth direction of the strand-like material laying device so that a cutting depth of the strand-like material laying device increases in a direction 180 degrees opposed to a direction of movement thereof, and wherein said two successive ones of the first plurality of first elements are coupled with each other for pivotal movement relative to each other about an axis being substantially parallel to the depth direction of the strand-like material laying device; and an off-road steerable chassis frame astraddle the strand-like material laying device and supporting the strand-like material laying device between a pair of left wheels and a pair of right wheels and enabling the strand-like material laying device to be vertically lifted and lowered away from and towards the ground, respectively.

22. The appliance according to claim 21, wherein the chassis frame is of the articulated frame type having a central structural framework which is supported on the pair of left wheels and the pair of right wheels by means of an articulating linkage assembly associated with each wheel and the framework.

23. The appliance according to claim 21, wherein the strand-like material laying device is connected at its front end side to the central structural framework for pivotal movement about an axis being substantially parallel to a width direction of the strand-like material laying device, and is coupled at its rear end side to means for vertically lifting and lowering the strand-like material laying device, which means is vertically slidably supported by the central structural framework.

* * * * *